US005368630A

United States Patent [19]

Luk

[11] Patent Number: 5,368,630

[45] Date of Patent: Nov. 29, 1994

[54] METAL POWDER COMPOSITIONS CONTAINING BINDING AGENTS FOR ELEVATED TEMPERATURE COMPACTION

[75] Inventor: Sydney Luk, Lafayette Hill, Pa.

[73] Assignee: Hoeganaes Corporation, Riverton, N.J.

[21] Appl. No.: 46,234

[22] Filed: Apr. 13, 1993

[51] Int. Cl.[5] ..... B22F 1/00

[52] U.S. Cl. ..... 75/252; 75/254; 75/231

[58] Field of Search ..... 75/252, 254, 255, 231

[56] References Cited

U.S. PATENT DOCUMENTS 4,483,905 11/1984 Engstrom ..... 423/570
4,508,567 4/1985 Mizuno et al. ..... 75/231
4,578,115 3/1986 Harrington et al. ..... 75/255
4,676,831 6/1987 Engstrom ..... 75/252
4,834,800 5/1989 Semel ..... 106/403
5,154,881 10/1992 Rutz et al. ..... 419/37

*Primary Examiner*—George Wyszomierski
*Attorney, Agent, or Firm*—Woodcock Washburn Kurtz Mackiewicz & Norris

[57] ABSTRACT

An improved metallurgical powder composition capable of being compacted at elevated temperatures is provided comprising an iron-based powder, an alloying powder, a high temperature compaction lubricant, and a binder. The selected binders of this invention permit the bonded powder composition to achieve increased compressibility in comparison to unbonded powder compositions while reducing dusting and segregation of the alloying powder.

30 Claims, No Drawings

METAL POWDER COMPOSITIONS CONTAINING BINDING AGENTS FOR ELEVATED TEMPERATURE COMPACTION

FIELD OF THE INVENTION

The present invention relates to metal powder compositions containing a lubricant for high temperature compaction and a binding agent to reduce dusting and segregation. The invention further relates to methods of compacting the metal powder compositions at elevated temperatures to make sintered components.

BACKGROUND OF THE INVENTION

Industrial usage of metal parts manufactured by the compaction and sintering of metal powder compositions is expanding rapidly into a multitude of areas. Manufacture of parts with metal powder compositions provides substantial benefits in comparison to use of a molten alloy in the manufacturing process. In the manufacture of such parts, iron or steel particulate powders are often admixed with at least one other alloying element that is also in particulate form. These alloying elements permit the attainment of higher strength and other mechanical properties in the final sintered part. The alloying elements typically differ from the base iron or steel powders in particle size, shape and density. For example, the average particle size of the iron-based powders is typically about 70–100 microns, or more, while the average particle size of most alloying ingredients can be less than about 20 microns, more often less than about 15 microns, and in some cases less than about 5 microns. The alloying powders are purposely used in such a finely-divided state to promote rapid homogenization of the alloy ingredients by solid-state diffusion during the sintering operation.

The disparity in particle size can lead to problems such as segregation and dusting of the finer alloying particles during transportation, storage, and use. Although the iron and alloy element powders are initially admixed into a homogeneous powder, the dynamics of handling the powder mixture during storage and transfer can cause the smaller alloying powder particles to migrate through the interstices of the iron-based powder matrix. The normal forces of gravity, particularly where the alloying powder is denser than the iron powder, cause the alloying powder to migrate downwardly toward the bottom of the mixture's container, resulting in a loss of homogeneity of the mixture, or segregation. On the other hand, air currents which can develop within the powder matrix as a result of handling can cause the smaller alloying powders, particularly if they are less dense than the iron powders, to migrate upwardly. If these buoyant forces are high enough, some of the alloying particles can, in the phenomenon known as dusting, escape the mixture entirely, resulting in a decrease in the concentration of the alloy element.

Various organic binders have been used to bind or "glue" the finer alloying powder to the coarser iron-based particles to prevent segregation and dusting for powders to be compacted at ambient temperatures. For example, U.S. Pat. No. 4,483,905 to Engström teaches the use of a binding agent that is broadly described as being of "a sticky or fat character" in an amount up to about 1% by weight of the powder composition. U.S. Pat. No. 4,676,831 to Engström discloses the use of certain tall oils as binding agents. Also, U.S. Pat. No. 4,834,800 to Semel discloses the use of certain film-forming polymeric resins that are generally insoluble in water as binding agents. These binders are effective in preventing segregation and dusting, but like any of the other organic binders used by the prior art, they can adversely affect the compressibility of the powder even when present in only small amounts.

The "compressibility" of a powder blend is a measure of its performance under various conditions of compaction. In the art of powder metallurgy, a powder composition is generally compacted under great pressure in a die, and the compacted "green" part is then removed from the die and sintered. It is recognized in this art that the density, and usually the strength, of this green part vary directly with the compaction pressure. In terms of "compressibility", one powder composition is said to be more compressible than another if, at a given compaction pressure, it can be pressed to a higher green density, or alternatively, if it requires less compaction pressure to attain a specified green density.

It is also known now that there are advantages to compressing powder compositions at elevated temperatures. See, for example, U.S. Pat. No. 5,154,881 to Rutz et al., which discloses enhancement in post-compaction properties such as green density and green strength due to the warm compaction procedure. The compaction at elevated temperatures requires the presence of a lubricant to facilitate ejection of the compacted part from the die. Although the green density of a compacted part generally increases with the compaction pressure, so do the friction forces that must be overcome to remove the compacted part from the die. The presence of the lubricant keeps the friction force from exceeding a level at which significant die wear would occur. Not all lubricants conventionally used in powder metallurgical processes retain their properties if compaction is performed at elevated temperatures. Rutz et al. disclose an amide lubricant that is suitable for warm compaction procedures.

SUMMARY OF THE INVENTION

The present invention provides a binder-containing, lubricated, metal powder composition that can be compacted at elevated temperatures. The compositions contain an iron-based metal powder, a minor amount of at least one alloying powder, a high temperature compaction lubricant for facilitating compaction of the powder composition at elevated compaction temperatures without causing excessive die wear, and an organic binder for the iron-based and alloying powders.

The preferred binders include cellulose ester resins, hydroxy alkylcellulose resins wherein the alkyl moiety has from 1–4 carbon atoms, thermoplastic phenolic resins, and mixtures thereof.

The high temperature compaction lubricant is generally one that can withstand a compaction temperature up to about 370° C. and can then maintain the peak pressure of ejecting the compact from the die below about 4 tsi. Preferred lubricants include molybdenum sulfide, boric acid, and an amide that is the reaction product of about 10–30 weight percent of a $C_6$–$C_{12}$ linear dicarboxylic acid, about 10–30 weight percent of a $C_{10}$–$C_{22}$ monocarboxylic acid, and about 40–80 weight percent of a diamine having the formula $(CH_2)_x(NH_2)_2$ where x is 2–6.

The present invention also provides methods of making a sintered metal part that include compacting the powder compositions in a die at a temperature of from about 100° C. to about 370° C. The compacted composition is then sintered to attain the final part.

DETAILED DESCRIPTION OF THE INVENTION

The present invention provides substantially dust-free, segregation-free metal powder compositions that can be compacted at elevated temperatures. The powder compositions contain an iron-based powder, a minor amount of at least one alloying powder, a high temperature compaction lubricant, and a high temperature binding agent. The present invention also provides methods for the preparation of a metal part from the powder compositions by compacting the composition at elevated temperatures followed by sintering.

The iron-based powders used in the metal powder compositions of the present invention are of the kind generally used in powder metallurgical methods.

The iron-based particles can be any of the iron or iron-containing (including steel) particles that can be admixed with particles of other alloying materials for use in standard powder metallurgical methods. Examples of iron-based particles are particles of pure or substantially pure iron; particles of iron pre-alloyed with other elements (for example, steel-producing elements); and particles of iron to which such other elements have been diffusion-bonded. The particles of iron-based material useful in this invention can have a weight average particle size up to about 500 microns, but generally the particles will have a weight average particle size in the range of about 10–350 microns. Preferred are particles having a maximum average particle size of about 150 microns, and more preferred are particles having an average particle size in the range of about 70–100 microns.

The preferred iron-based particles for use in the invention are highly compressible powders of substantially pure iron; that is, iron containing not more than about 1.0% by weight, preferably no more than about 0.5% by weight, of normal impurities. Examples of such metallurgical-grade pure iron powders are the ANCORSTEEL 1000 series of iron powders (e.g. 1000, 1000B, and 1000C) available from Hoeganaes Corporation, Riverton, N.J. For example, ANCORSTEEL 1000 iron powder, has a typical screen profile of about 22% by weight of the particles below a No. 325 sieve (U.S. series) and about 10% by weight of the particles larger than a No. 100 sieve with the remainder between these two sizes (trace amounts larger than No. 60 sieve). The ANCORSTEEL 1000 powder has an apparent density of from about 2.85–3.00 g/cm$^3$, typically 2.94 g/cm$^3$. Other iron powders that can be used in the invention are typical sponge iron powders, such as Hoeganaes' ANCOR MH-100 powder.

Pre-alloyed iron-based powders suitable for use in the compositions of the invention can be prepared by making a melt of iron, preferably substantially pure iron, and the desired alloying elements, and then atomizing the melt, whereby the atomized droplets form the powder upon solidification. Examples of alloying elements that can be pre-alloyed with the iron powder include, but are not limited to, molybdenum, manganese, magnesium, chromium, silicon, copper, nickel, gold, vanadium, columbium (niobium), graphite, phosphorus, aluminum, and combinations thereof. The amount of the alloying element or elements incorporated depends upon the properties desired in the final metal part. Pre-alloyed iron powders that incorporate such alloying elements are available from Hoeganaes Corp. as part of its ANCORSTEEL line of powders.

An example of a pre-alloyed iron-based powder is iron pre-alloyed with molybdenum (Mo), a preferred version of which can be produced by atomizing a melt of substantially pure iron containing from about 0.5 to about 2.5 weight percent Mo. Such a powder is commercially available as Hoeganaes ANCORSTEEL 85HP steel powder, which contains 0.85 weight percent Mo, less than about 0.4 weight percent, in total, of such other materials as manganese, chromium, silicon, copper, nickel, or aluminum, and less than about 0.02 weight percent carbon. Other commercially available pre-alloyed iron-based powders preferred for use herein include Hoeganaes' ANCORSTEEL 150HP, 2000 and 4600V atomized steel powders.

The diffusion-bonded iron-based particles are particles of substantially pure iron that have a layer or coating of one or more other metals, such as steel-producing elements, diffused into their outer surfaces. One such commercially available powder is DISTALOY 4800A diffusion bonded powder from Hoeganaes Corporation, which contains 4% nickel, 0.55% molybdenum, and 1.6% copper.

The alloying materials that are admixed with iron-based particles of the kind described above are those known in the metallurgical arts to enhance the strength, hardenability, electromagnetic properties, or other desirable properties of the final sintered product. Steel-producing elements are among the best known of these materials. Specific examples of alloying materials include, but are not limited to, elemental molybdenum, manganese, chromium, silicon, copper, nickel, tin, vanadium, columbium (niobium), metallurgical carbon (graphite), aluminum, sulfur, and combinations thereof. Other suitable alloying materials are binary alloys of copper with tin or phosphorus; ferro-alloys of manganese, chromium, boron, phosphorus, or silicon; low-melting ternary and quaternary eutectics of carbon and two or three of iron, vanadium, manganese, chromium, and molybdenum; carbides of tungsten or silicon; silicon nitride; and sulfides of manganese or molybdenum.

The alloying materials are used in the composition in the form of particles that are generally of finer size than the particles of iron-based material with which they are admixed. The alloying-material particles generally have a weight average particle size below about 100 microns, preferably below about 75 microns, more preferably below about 30 microns, and most preferably in the range of about 5–20 microns. The amount of alloying material present in the composition will depend on the properties desired of the final sintered part. Generally the amount will be minor, up to about 7% by weight of the total powder weight or more usually in the range of about 0.25–5%, although as much as 10–15% by weight can be present for certain specialized powders. A preferred range suitable for most applications is about 0.25–4% by weight.

The metal powder compositions that are the subject of the present invention also contain a high temperature compaction lubricant. This lubricant is functionally defined as a powder metallurgy lubricant that can withstand the elevated compaction temperatures associated with warm compaction techniques. These temperatures generally range from about 100° C. (212° F.) up to about 370° C. (700° F.). The high temperature lubricant is preferably selected so as to maintain the peak ejection pressures of the compact from the die below about 4 tsi, preferably below about 3.5 tsi, and more preferably below about 3 tsi. The peak ejection pressure is a quantitative measurement of the ejection force required to start moving the compacted part from the die. The method for determining the peak ejection pressure is set forth in U.S. Pat. No. 5,154,881.

Examples of preferred lubricants include boric acid, molybdenum sulfide, and polyamide materials that are, in essence, high melting-point waxes. The polyamide lubricant is the condensation product of a dicarboxylic acid, a monocarboxylic acid, and a diamine.

In preferred embodiments of the polyamide lubricant, the dicarboxylic acid is a linear acid having the general formula HOOC(R)COOH where R is a saturated or unsaturated linear aliphatic chain of 4–10, preferably about 6–8, carbon atoms. Preferably, the dicarboxylic acid is a $C_8$–$C_{10}$ saturated acid. Sebacic acid is a preferred dicarboxylic acid. The dicarboxylic acid is present in an amount of from about 10 to about 30 weight percent of the starting reactant materials.

The monocarboxylic acid is a saturated or unsaturated $C_{10}$–$C_{22}$ fatty acid. Preferably, the monocarboxylic acid is a $C_{12}$–$C_{20}$ saturated acid. Stearic acid is a preferred saturated monocarboxylic acid. A preferred unsaturated monocarboxylic acid is oleic acid. The monocarboxylic acid is present in an amount of from about 10 to about 30 weight percent of the starting reactant materials.

The diamine has the general formula $(CH_2)_x(NH_2)_2$ where x is an integer of about 2–6. Ethylene diamine is the preferred diamine. The diamine is present in an amount of from about 40 to about 80 weight percent of the starting reactant materials.

The condensation reaction is preferably conducted at a temperature of from about 260°–280° C. and at a pressure up to about 7 atmospheres. The reaction is allowed to proceed to completion, usually not longer than about 6 hours. The polyamide is preferably produced under an inert atmosphere such as nitrogen. The reaction is preferably carried out in the presence of a catalyst such as 0.1 weight percent methyl acetate and 0.001 weight percent zinc powder. The lubricants formed by the condensation reaction are polyamides characterized as having a melting range rather than a melting point. As those skilled in the art will recognize, the reaction product is generally a mixture of moieties whose molecular weights, and therefore properties dependent on such, will vary. As a whole, the polyamide lubricant begins to melt at a temperature between about 150° C. (300° F.) and 260° C. (500° F.), preferably about 200° C. (400° F.) to about 260° C. (500° F.). The polyamide will generally be fully melted at a temperature about 250 degrees centigrade above this initial melting temperature, although it is preferred that the polyamide reaction product melt over a range of no more than about 100 degrees centigrade.

A preferred such polyamide lubricant is commercially available as ADVAWAX 450, or PROMOLD 450, polyamide sold by Morton International of Cincinnati, Ohio, which is an ethylene bis-stearamide having an initial melting point between about 200° C. and 300° C.

The high temperature lubricant will generally be added to the composition in the form of solid particles. The particle size of the lubricant can vary, but is preferably below about 100 microns. Most preferably the lubricant particles have a weight average particle size of about 10–50 microns. The lubricant is admixed with the iron-based powder in an amount up to about 15% by weight of the total composition. Preferably the amount of lubricant is from about 0.1 to about 10 weight percent, more preferably about 0.1–2 weight percent, and most preferably about 0.2–1 weight percent, of the composition.

The binding agents are polymeric resin materials that can be either soluble or insoluble in water, although it is preferred that the resin be insoluble in water. Preferably, the resin will have the capacity to form a film, in either its natural liquid state or as dissolved in a solvent, around the iron-based powder and the alloying powder. It is important that the binding agent resin be selected such that it will not adversely affect the elevated temperature compaction process. The binding agent should also pyrolyze cleanly upon sintering of the compacted part to avoid the presence of organic residue within the part, which could cause a decrease in mechanical properties. Preferred binding agents include cellulose ester resins, high molecular weight thermoplastic phenolic resins, hydroxyalkylcellulose resins, and mixtures thereof.

The cellulose ester binding agents include the commercially available cellulose ester resins such as cellulose acetate, cellulose acetate butyrate, and cellulose acetate propionate. Preferred cellulose ester resins are those manufactured by Eastman Chemical Products designated as the CA, CAB, and CAP resins.

Preferred cellulose acetate resins are those having a melting range of from about 230°–260° C., a $T_g$ of from about 180°–190° C., an acetyl content of about 39–40% by weight, a number average molecular weight of from about 30,000 to about 70,000, and a viscosity (ASTM-D817, formula A; ASTM-D1343) of from about 10 to about 230 poises. Commercially available cellulose acetate resins are the CA-398 and CA-394 series.

Preferred cellulose acetate butyrate resins are those having a melting range of from about 120°–240° C., a $T_g$ of from about 80°–170° C., an acetyl content of about 2–30% by weight, preferably from about 2–15% by weight; a butyryl content of from about 17–55% by weight, preferably about 30–55% by weight; a number average molecular weight of from about 10,000 to about 100,000, and a viscosity (ASTM-D817, formula A; ASTM-D1343) of from about 0.03 to about 80 poises. Commercially available cellulose acetate resins are the CAB-171, -321, -381, -500, -531, -553, and -551 series.

Preferred cellulose acetate propionate resins are those having a melting range of from about 180°–210° C., a $T_g$ of from about 140°–160° C., an acetyl content of about 0.5–3% by weight, a propionyl content of from about 40 to about 50% by weight, a number average molecular weight of from about 10,000 to about 100,000, and a viscosity (ASTM-D817, formula A; ASTM-D1343) of from about 0.5 to about 80 poises. Commercially available cellulose acetate resins are the CAP-482 and -504 series.

The high molecular weight thermoplastic phenolic resins are a reaction product of natural wood rosins and tall oil rosins. Generally, the starting rosin material is composed of a mixture of various resin acids having the general formula $C_{20}H_xO_2$ where x is from about 26–34, preferably 28–32, and are typically derived from stumpwoods. The resin acids are generally tri-cyclic fused ring molecules and include such acids as abietic acid, dihydroabietic acid, dehydroabietic acid, neoabietic acid, palustric acid, isopimaric acid, pimaric acid, and mixtures thereof. The thermoplastic phenolic resin is the product obtained from subjecting the resin acids to esterification and Dieis-Alder reaction. The esters are formed by reaction with a compound containing an alcohol moiety such as, for example, methanol, ethylene and diethylene glycol, glycerol, and pentaerythritol. The Dieis-Alder reaction produces adduct compounds and the reactants include such compounds as maleic anhydride and fumaric acid.

The esters formed from the acid resin reaction when reacted in the presence of the adduct compounds form a thermoplastic phenolic resin. The molecular weight of the phenolic resin ranges between 10,000 to 800,000 on a number average basis. The adduct compounds aid in the softening characteristics of the phenolic resin. The softening temperature of the phenolic resin is from about 110°–130° C.

The phenolic resin is typically available as a mixture with the resin acids. The phenolic resins are present preferably in an amount of from about 40–60% wt. and the resin acids are present preferably in about 60–40% wt. of the phenolic resin composition. An example of a commercially available phenolic resin composition is VINSOL resin and its sodium soap VINSOL MM available from Hercules Inc.

The hydroxyalkylcellulose resins are preferably water soluble resins wherein the alkyl moiety has from 1–4 carbon atoms, and is preferably a saturated $C_{1-4}$ molecule, more preferably ethyl or propyl. The resins are prepared by reacting alkali cellulose with an alkylene oxide at elevated temperatures and pressures. The weight average molecular weight of the resin is preferably from about 50,000 to about 1,200,000. Commercially available resins include the hydroxypropylcellulose resins from Aqualon Co. as the KLUCEL series, preferably the KLUCEL G and M resins. A commercially available hydroxyethylcellulose resin is the NATROSOL 250 resin from Aqualon Co.

The binding agent is present in the powder composition in an amount of from about 0.005–3% wt., preferably 0.05–1.5% wt., more preferably about 0.1–1% wt., of the powder composition.

The metal powder composition is prepared by blending the constituents together using conventional blending techniques. Typically, the base metal powder and alloying powders are blended together using conventional dry powder blenders or mixers. The binding agent can then be added to the powder mixture according to the procedures taught by U.S. Pat. No. 4,834,800 to Semel, which is hereby incorporated by reference in its entirety. Generally, the binding agent is admixed, preferably in liquid form, with the powders for a time sufficient to achieve good wetting of the powders. The binding agent is preferably dissolved or dispersed in an organic solvent to provide better dispersion of the binding agent in the powder mixture, thus providing a substantially homogeneous distribution of the binding agent throughout the mixture. The lubricant can be added, generally in dry particulate form, either before or after the above-described binder addition step. Preferably, the lubricant is added before the binder in a procedure in which the iron-based powder alloying powder, and lubricant, in particulate form are dry-blended, after which the binder is added.

The lubricant can also be added in a two-step method in which a portion of the lubricant, from about 50 to about 99 weight percent, preferably from about 75 to about 95 weight percent, of the total lubricant, is dry blended with the iron and alloying powders. The binding agent is then added, solvent from the binder addition removed, and the balance of the lubricant then added.

The metal powder composition containing the iron-based metal powder, alloying powders, the lubricant, and the binding agent, as above described, is compacted in a die according to standard metallurgical techniques at "warm" temperatures as understood in the metallurgy arts. The metal powder composition is compressed at a compaction temperature—measured as the temperature of the composition as it is being compacted—up to about 370° C. (700° F). Preferably the compaction is conducted at a temperature of at least above 100° C. (212° F.), preferably at a temperature of from about 150° C. (300° F.) to about 370° C. (700° F.), more preferably from about 175° C. (350° F.) to about 260° C. (500° F.). Typical compaction pressures are about 5–200 tons per square inch (tsi) (69–2760 MPa), preferably about 20–100 tsi (276–1379 MPa), and more preferably about 25–60 tsi (345–828 MPa).

Following compaction, the part is sintered, according to standard metallurgical techniques, at temperatures and other conditions appropriate to the composition of the iron-based powder.

EXAMPLES

Example 1

The method of addition of the high temperature compaction lubricant was studied with respect to the physical properties of the blended powder.

Table 1 shows the effects on the apparent density (A.D.)(ASTM-B212-76), flow (ASTM B213-77), and dust resistance from the sequence of constituent addition. The green density (ASTM B331-76) of compacts (bars measuring about 1.25 inches in length, about 0.5 inches in width, and about 0.25 inches in height) made from the compaction of the powders at 50 tsi and at a compaction temperature of about 149° C. (300° F.) was also studied. The reference metal powder contained 98.65% wt. DISTALOY 4800A steel powder, 0.6% wt. graphite powder (20 micron average particle size), and 0.75% wt. PROMOLD 450. The metal powder compositions containing an added binding agent were designated as those powders having the prefix A, B or C. The bonded powders contained 98.65% wt. DISTALOY 4800A, 0.6% wt. graphite powder, and 0.6% wt. PROMOLD 450, and 0.15% wt. binder. The amount of organic material was therefore held constant between the reference and bonded samples at 0.75% wt. The binding agents were VINSOL resin, binding agent A; Eastman CAB-551-0.01, binding agent B; and Eastman CA-398-3, binding agent C. The physical location of the constituents was varied in three ways and is represented in Table 1 by binding agent positions 1, 2, and 3.

TABLE 1

| Powder | A.D. | Flow | Dust Resistance | Green Density |
|---|---|---|---|---|
| Control | 2.91 | 31 | 45 | 7.30 |
| A1 | 2.81 | 28 | 94 | 7.30 |
| A2 | 2.92 | 28 | 94 | 7.29 |
| A3 | 2.75 | — | 99 | 7.27 |
| B1 | 3.07 | 25 | 97 | 7.29 |
| B2 | 3.09 | 25 | 92 | 7.30 |
| B3 | 2.79 | — | 99 | 7.27 |
| C1 | 2.90 | 26 | 94 | 7.30 |
| C2 | 3.05 | 25 | 94 | 7.31 |
| C3 | 2.78 | — | 100 | 7.28 |

The metal powder composition designated by position 1 was prepared by dry mixing the iron powder, graphite and lubricant powders in standard laboratory bottle-mixing equipment for 15–30 minutes. The binding agent, dissolved in acetone (about 10% wt.), was then poured into the mixture and blended with a spatula in an appropriately sized steel bowl until the powder was well wetted. The solvent was then removed. The binding agent position 2 powders were prepared in the same manner as the position 1 powders except that the iron powder, graphite, and a majority of the lubricant, in this case about 92% of the lubricant or about 0.55% wt. of the total composition, was first dry blended. Then the binding agent, dissolved in acetone, was admixed and blended with the powder mixture, and the solvent was removed. Finally, the remaining amount of lubricant was blended with the powder composition. The binding agent position 3 powders were prepared in the same manner as position 1 powders except that the lubricant was not added until after the binding agent was added and the solvent was removed. The reference powder was prepared by dry blending all of its constituent powders.

Blending was conducted in all cases until the powder composition reached a substantially homogeneous state. The solvent was removed in all cases by spreading out the powder on a shallow metal tray and allowing the powder to dry. After drying, the mixture was coaxed thought a 40-mesh screen to break up any large agglomerates which may have formed during the drying. A portion of each powder mixture sample so made was set aside for chemical analysis and dusting-resistance determinations. The remainder of the powder mixture was used for testing various properties according to the procedures described below.

The dust resistance of the reference and test powders was determined using the test method set forth in U.S. Pat. No. 4,834,800. The mixtures were tested for dusting resistance by elutriating them with a controlled flow of nitrogen. The test apparatus consisted of a cylindrical glass tube vertically mounted on a two-liter Erlenmeyer flask equipped with a side port to receive the flow of nitrogen. The glass tube (17.5 cm in length, 2.5 cm inside diameter) was equipped with a 400 mesh screen plate positioned about 2.5 cm above the mouth of the flask. A sample of the powder mixture to be tested (20–25 grams) was placed on the screen plate and nitrogen was passed through the tube at the rate of two liters per minute for 15 minutes. At the conclusion of the test, the powder mixture was analyzed to determine the relative amount of alloying powder remaining in the mixture (expressed as a percentage of the before-test concentration of the alloying powder), which is a measure of the composition's resistance to the loss of the alloying powder through dusting and/or segregation. The dust resistance data shows that the graphite was retained at above about 90 percent by weight in all of the bonded samples.

The binding agent position 2 was found to achieve the highest apparent density for all three binding agents. The binding agent position 3 was found to achieve the highest dust resistance of the graphite, however these powders did not flow. The binding agents were found to increase the green density, and thus the compressibility, of the powder composition. The highest green density was achieved by binding agent C using binding agent position 2.

Example 2

The powder samples denoted as A2, B2, and C2 from Example 1 were further studied in comparison to the reference sample from Example 1 for compacted or "green" properties and for sintered properties following warm temperature compaction. The powder samples were compacted into bars measuring about 1.25 inches in length, about 0.5 inches in width, and about 0.25 inches in height at a pressure of 50 tsi at compaction temperatures of 27° C. (80° F.), 149° C. (300° F.), and 204° C. (400° F.). The compacts were then sintered at 2050° F. in a dissociated ammonia atmosphere (75%$H_2$/25%$N_2$) for 30 minutes.

The results from the various compaction temperature experiments are shown in Tables 2.1 through 2.3. The green density (ASTM B331-76), green strength (ASTM B312-76), green expansion (percentage change in length of green specimen relative to die cavity), peak ejection force, sintered density (ASTM B331-76), transverse rupture strength (ASTM B528-76), Rockwell hardness (ASTM E110-82), and dimensional change (ASTM B610-76) were determined. The carbon and oxygen contents after sintering were also determined for the compaction at 149° C. (300° F.). The density, strength and ejection force pressures are all advantageously improved due to the compaction at the elevated temperatures.

TABLE 2.1

| Compaction Temperature - 27° C. (80° F.) | | | | | |
|---|---|---|---|---|---|
| | | Reference | A2 | B2 | C2 |
| Green Density | (g/cm$^3$) | 7.06 | 7.12 | 7.13 | 7.13 |
| Green Strength | (psi) | 2900 | 2700 | 2900 | 2800 |
| Green Expansion | (%) | 0.30 | 0.28 | 0.29 | 0.28 |
| Ejection Peak | (tsi) | 4.22 | 4.29 | — | 4.48 |
| Sintered Density | (g/cm$^3$) | 7.06 | 7.13 | 7.14 | 7.14 |
| TRS | (ksi) | 201 | 217 | 203 | 231 |
| Dimensional Change-Die | (%) | 0.14 | 0.08 | 0.12 | 0.10 |
| Dimensional Change-Compact | (%) | −0.16 | −0.20 | −0.17 | −0.18 |

TABLE 2.2

| Compaction Temperature - 149° C. (300° F.) | | | | | |
|---|---|---|---|---|---|
| | | Reference | A2 | B2 | C2 |
| Green Density | (g/cm$^3$) | 7.26 | 7.29 | 7.30 | 7.31 |
| Green Strength | (psi) | 4400 | 5100 | 4900 | 5500 |
| Green Expansion | (%) | 0.38 | 0.34 | 0.30 | 0.28 |
| Ejection Peak | (tsi) | 2.55 | 2.88 | 2.80 | 2.88 |
| Sintered Density | (g/cm$^3$) | 7.24 | 7.29 | 7.28 | 7.29 |
| Dimensional Change-Die | (%) | 0.18 | 0.16 | 0.14 | 0.14 |
| TRS | (ksi) | 237 | 258 | 246 | 260 |
| Hardness | ($R_b$) | 23 | 25 | 23 | 24 |
| Carbon | | 0.54 | 0.55 | 0.54 | 0.53 |
| Oxygen | | 0.13 | 0.13 | 0.18 | 0.12 |
| Dimensional Change-Compact | (%) | −0.13 | −0.12 | −0.009 | −0.009 |

TABLE 2.3

| | | Compaction Temperature - 204° C. (400° F.) | | | |
|---|---|---|---|---|---|
| | | Reference | A2 | B2 | C2 |
| Green Density | (g/cm$^3$) | 7.21 | 7.25 | 7.33 | 7.31 |
| Green Strength | (psi) | 4900 | 5700 | 5900 | 6000 |
| Green Expansion | (%) | 0.48 | 0.37 | 0.34 | 0.27 |
| Ejection Peak | (tsi) | 3.11 | 3.37 | — | 3.25 |
| Sintered Density | (g/cm$^3$) | 7.25 | 7.29 | 7.31 | 7.30 |
| TRS | (ksi) | 250 | 263 | 260 | 250 |
| Dimensional Change-Die | (%) | 0.25 | 0.18 | 0.21 | 0.18 |
| Dimensional Change-Compact | (%) | −0.23 | −0.19 | −0.13 | −0.009 |

The green properties of the warm compacted parts made from the powder composition containing the binding agent are superior to those made with the reference powder. The green density, or compressibility, and green strength of the compacts containing the binding agent showed increases over the reference powder. The green expansion, a measure of the springback of the dimensions of the green compact after it is ejected from the die cavity, was decreased in the binding agent compacts. The lower green expansion indicates that there would be less variability between compacts made from a die during a production run using the powder compositions containing the binding agents. Binding agent C, having the highest melting point, yielded the lowest green expansion at the higher compaction temperature.

The sintered properties show that the compacts made with a powder containing the binding agent showed improved sintered density and strength.

An important aspect in the manufacture of high performance precision metal parts from metal powder compositions is the dimensional change of the compact from the die size and from the green compact after sintering. The dimensional change from the die size and from the green compact is significantly reduced at the elevated compaction temperatures for the parts made with the binding agent in the powder composition.

The peak ejection forces are higher for the compacts containing the binding agent. However, the ejection forces are well within the tolerance levels for die wear.

Example 3

Various types of binding agents and blends thereof were admixed with a base metal powder blend and analyzed for their powder properties including their green and sintered compact properties. The powder compositions contained 98.65% wt. DISTALOY 4800A iron powder, 0.6% wt. graphite, 0.6% wt. PROMOLD 450 lubricant, and 0.15% wt. binding agent. The reference powder contained no binding agent and 0.75% wt. lubricant. The binding agents, or blends thereof, are set forth in Table 3.1.

TABLE 3.1

| Mix | Chemical | Molecular Weight | Tg (°C.) | Trade Name |
|---|---|---|---|---|
| D | Cellulose Acetate Butyrate | 16,000 | 85 | CAB-551-0.01 |
| E | Cellulose Acetate Butyrate | 30,000 | 101 | CAB-551-0.2 |
| F | Cellulose Acetate Butyrate | 57,000 | 96 | CAB-500-5 |
| H | Cellulose Acetate Propionate | 25,000 | 142 | CAP-482-0.5 |

TABLE 3.1-continued

| Mix | Chemical | Molecular Weight | Tg (°C.) | Trade Name |
|---|---|---|---|---|
| G | Cellulose Acetate Butyrate | 20,000 | 123 | CAB-381 0.1 |
| I | Cellulose Acetate Butyrate | 70,000 | 141 | CAB-381-20 |
| J | Cellulose Acetate | 50,000 | 189 | CA-398-30 |
| K | 50% H + 50% D | — | — | — |
| L | 50% Cellulose Acetate* + 50% D | — | — | *CA-393-20 |
| M | Hydroxypropylcellulose | 370,000 | | KLUCEL G |
| N | Hydroxypropylcellulose | 850,000 | | KLUCEL M |

The powder compositions were prepared by first blending the DISTALOY 4800A and graphite powders together with about 92% wt. of the PROMOLD 450 lubricant (0.55% wt. composition). The binding agent, dissolved in acetate, was then sprayed onto the powder mix and blending was conducted until the powder was evenly wetted. The acetate was then removed by drying and the rest of the lubricant was blended with the powder composition.

The powder composition properties of flow and apparent density are set forth in Table 3.2. The presence of the binding agent improved both the flow and apparent density of the powder compositions.

TABLE 3.2

| | Flow (sec/50 grams) at 22° C. | Apparent density (g/cm$^3$) at 22° C. |
|---|---|---|
| REF | 31.33 | 2.94 |
| D | 26.18 | 3.05 |
| E | 25.22 | 3.11 |
| F | 24.30 | 3.14 |
| G | 25.62 | 3.10 |
| H | 24.92 | 3.11 |
| I | 24.17 | 3.13 |
| J | 24.83 | 3.11 |
| K | 26.35 | 3.04 |
| L | 26.31 | 3.04 |
| M | 24.56 | 3.02 |
| N | 23.00 | 3.07 |

The powder compositions were compacted into bars measuring about 1.25 inches in length, about 0.5 inches in width, and about 0.25 inches in height at a pressure of 50 tsi at compaction temperatures of 149° C. (300° F.) and 204° C. (400° F.). The compacts were then sintered at 1120° C. (2050° F.) in a dissociated ammonia atmosphere (75%$H_2$/25%$N_2$) for 30 minutes. The results of the testing are shown in Tables 3.3 and 3.4.

TABLE 3.3

| | Compaction Temperature - 149° C. (300° F.) | | | | | |
|---|---|---|---|---|---|---|
| | Green Density (g/cm$^3$) | Green Expansion (%) | Sintered Density (g/cm$^3$) | Dimensional Change-Die (%) | TRS (ksi) | $R_b$ |
| REF | 7.25 | 0.34 | 7.25 | 0.19 | 231,960 | 21 |
| D | 7.29 | 0.27 | 7.26 | 0.19 | 232,960 | 22 |
| E | 7.32 | 0.26 | 7.29 | 0.20 | 232,630 | 23 |
| F | 7.31 | 0.26 | 7.29 | 0.19 | 232,530 | 23 |
| G | 7.30 | 0.25 | 7.27 | 0.18 | 232,890 | 23 |
| H | 7.30 | 0.26 | 7.28 | 0.19 | 231,990 | 23 |
| I | 7.29 | 0.27 | 7.30 | 0.16 | 235,020 | 24 |
| J | 7.28 | 0.27 | 7.28 | 0.16 | 236,950 | 23 |
| K | 7.28 | 0.27 | 7.29 | 0.17 | 236,650 | 23 |
| L | 7.28 | 0.28 | 7.30 | 0.17 | 236,580 | 22 |
| M | 7.27 | 0.26 | 7.27 | 0.17 | 234,330 | 23 |
| N | 7.27 | 0.27 | 7.28 | 0.16 | 233,480 | 22 |

TABLE 3.4

| | Compaction Temperature - 204° C. (400° F.) | | | | | |
|---|---|---|---|---|---|---|
| | Green Density (g/cm$^3$) | Green Expansion (%) | Sintered Density (g/cm$^3$) | Di-mensional Change-Die (%) | TRS (ksi) | $R_b$ |
| REF | 7.19 | 0.45 | 7.22 | 0.24 | 253,720 | 22 |
| D | 7.29 | 0.32 | 7.28 | 0.21 | 269,020 | 23 |
| E | 7.30 | 0.33 | 7.32 | 0.21 | 252,530 | 24 |
| F | 7.31 | 0.32 | 7.30 | 0.21 | 263,810 | 24 |
| G | 7.32 | 0.33 | 7.30 | 0.21 | 252,040 | 23 |
| H | 7.30 | 0.34 | 7.29 | 0.22 | 254,240 | 22 |
| I | 7.32 | 0.32 | 7.30 | 0.22 | 247,440 | 22 |
| J | 7.30 | 0.34 | 7.31 | 0.20 | 256,270 | 22 |
| K | 7.30 | 0.32 | 7.28 | 0.21 | 245,660 | 22 |
| L | 7.29 | 0.34 | 7.29 | 0.20 | 246,610 | 23 |
| M | 7.29 | 0.33 | 7.28 | 0.20 | 258,240 | 24 |
| N | 7.28 | 0.33 | 7.27 | 0.17 | 246,940 | 23 |

What is claimed is:

1. An improved metallurgical powder composition comprising:

(a) an iron-based metal powder;

(b) a minor amount of at least one alloying powder;

(c) an amount up to about 15% by weight of a high temperature compaction lubricant, said amount sufficient to allow compaction of the powder composition at elevated temperatures in a die, said lubricant comprising a polyamide lubricant that is the reaction product of about 10–30 weight percent of a $C_6$–$C_{12}$ linear dicarboxylic acid, about 10–30 weight percent of a $C_{10}$–$C_{22}$ monocarboxylic acid, and about 40–80 weight percent of a diamine having the formula $(CH_2)_x(NH_2)_2$ where x is 2–6; and (d) a minor amount of an organic binder for the iron-based and alloying powders, the binder comprising a resin selected from the group consisting of:

(1) cellulose ester resins;

(2) hydroxy alkylcellulose resins wherein the alkyl moiety has from 1–4 carbon atoms; and (3) thermoplastic phenolic resins.

2. The composition of claim 1 in which the lubricant further comprises boric acid, molybdenum sulfide, or mixtures of these.

3. The composition of claim 1 wherein the lubricant is present in an amount of from about 0.1–2% by weight of the composition.

4. The composition of claim 3 wherein the binder is present in an amount of from about 0.005–3% by weight of the composition.

5. The composition of claim 4 wherein the binder comprises cellulose acetate having a number average molecular weight of from about 30,000 to about 70,000.

6. The composition of claim 4 wherein the binder comprises cellulose acetate butyrate having a number average molecular weight of from about 10,000 to about 100,000.

7. The composition of claim 4 wherein the binder comprises cellulose acetate propionate having a number average molecular weight of from about 10,000 to about 100,000.

8. The composition of claim 4 wherein the binder comprises a thermoplastic phenolic resin having a number average molecular weight of from about 10,000 to about 800,000.

9. The composition of claim 4 wherein the binder comprises hydroxypropylcellulose having a molecular weight of from about 50,000 to about 1,200,000.

10. The composition of claim 4 wherein the binder comprises hydroxyethylcellulose having a molecular weight of from about 50,000 to about 1,200,000.

11. The composition of claim 4 wherein the alloying powder is present in an amount of from about 0.25% to about 5% by weight of the composition.

12. The composition of claim 3 wherein the lubricant consists essentially of said polyamide; and the binder is a hydroxy alkylcellulose resin or a thermoplastic phenolic resin.

13. The composition of claim 12 wherein the monocarboxylic acid comprises stearic acid.

14. The composition of claim 12 wherein the dicarboxylic acid comprises sebacic acid.

15. The composition of claim 12 wherein the diamine comprises ethylene diamine.

16. The composition of claim 12 wherein the monocarboxylic acid comprises stearic acid, the dicarboxylic acid comprises sebacic acid and the diamine comprises ethylene diamine; and wherein the polyamide lubricant has a melting range that begins at a temperature of at least about 150° C.

17. An improved metallurgical powder composition comprising:

(a) an iron-based metal powder having a weight average particle size of from 10–350 microns;

(b) from about 0.25–5% by weight of an alloying powder having a weight average particle size below about 75 microns;

(c) from about 0.1–2% by weight of a polyamide lubricant that is the reaction product of about 10–30 weight percent of a $C_6$–$C_{12}$ linear dicarboxylic acid, about 10–30 weight percent of a $C_{10}$–$C_{22}$ monocarboxylic acid, and about 40–80 weight percent of a diamine having the formula $(CH_2)_x(NH_2)_2$ where x is 2–6; and (d) from about 0.005–3% by weight of an organic binder for the iron-based and alloying powders, the binder comprising a resin selected from the group consisting of:

(1) cellulose ester resins;

(2) hydroxy alkylcellulose resins wherein the alkyl moiety has from 1–4 carbon atoms; and (3) thermoplastic phenolic resins.

18. The composition of claim 17 wherein said binder is present in an amount of from about 0.05–1.5% by weight of the composition.

19. The composition of claim 18 wherein the binder comprises cellulose acetate having a number average molecular weight of from about 30,000 to about 70,000.

20. The composition of claim 18 wherein the binder comprises cellulose acetate butyrate having a number average molecular weight of from about 10,000 to about 100,000.

21. The composition of claim 18 wherein the binder comprises cellulose acetate propionate having a number average molecular weight of from about 10,000 to about 100,000.

22. The composition of claim 18 wherein the binder comprises a thermoplastic phenolic resin having a number average molecular weight of from about 10,000 to about 800,000.

23. The composition of claim 18 wherein the binder comprises hydroxypropylcellulose having a molecular weight of from about 100,000 to about 1,200,000.

24. The composition of claim 18 wherein the binder comprises hydroxyethylcellulose having a molecular weight of from about 100,000 to about 1,200,000.

25. The composition of claim 18 wherein the monocarboxylic acid comprises stearic acid.

26. The composition of claim 18 wherein the dicarboxylic acid comprises sebacic acid.

27. The composition of claim 18 wherein the diamine comprises ethylene diamine.

28. The composition of claim 18 wherein the monocarboxylic acid comprises stearic acid, the dicarboxylic acid comprises sebacic acid and the diamine comprises ethylene diamine; and wherein the polyamide lubricant has a melting range that begins at a temperature of at least about 150° C.

29. An improved metallurgical powder composition consisting of:

(a) an iron-based metal powder having a weight average particle size of from about 10–350 microns;

(b) from about 0.25–5% by weight of an alloying powder having a weight average particle size below about 30 microns;

(c) from about 0.1–2% by weight of a polyamide lubricant that is the reaction product of about 10–30 weight percent of a $C_6$–$C_{12}$ linear dicarboxylic acid, about 10–30 weight percent of a $C_{10}$–$C_{22}$ monocarboxylic acid, and about 40–80 weight percent of a diamine having the formula $(CH_2)_x(NH_2)_2$ where x is 2–6; and (d) from about 0.005–3% by weight of an organic binder for the iron-based and alloying powders, the binder comprising a resin selected from the group consisting of:

(1) cellulose ester resins;

(2) hydroxy alkylcellulose resins wherein the alkyl moiety has from 1–4 carbon atoms; and (3) thermoplastic phenolic resins.

30. The composition of claim 29 wherein the monocarboxylic acid comprises stearic acid, the dicarboxylic acid comprises sebacic acid and the diamine comprises ethylene diamine; and wherein the polyamide lubricant has a melting range that begins at a temperature of at least about 150° C.

* * * * *